US006404177B2

(12) United States Patent
Wang

(10) Patent No.: US 6,404,177 B2
(45) Date of Patent: Jun. 11, 2002

(54) BANDGAP VOLTAGE REFERENCE SOURCE

(75) Inventor: Zhenhua Wang, Zurich (CH)

(73) Assignee: Koninklijke Philips Electronics N.V., Eindhoven (NL)

( * ) Notice: Subject to any disclaimer, the term of this patent is extended or adjusted under 35 U.S.C. 154(b) by 0 days.

(21) Appl. No.: 09/761,255

(22) Filed: Jan. 16, 2001

(30) Foreign Application Priority Data

Jan. 19, 2000 (EP) ..... 00200206

(51) Int. Cl.[7] ..... G05F 3/16
(52) U.S. Cl. ..... 323/313; 327/539
(58) Field of Search ..... 323/312, 313, 323/314, 907; 327/538, 539, 540, 545

(56) References Cited

U.S. PATENT DOCUMENTS 5,168,210 A * 12/1992 Thus ..... 323/313
5,796,244 A * 8/1998 Chen et al. ..... 323/313
6,147,548 A * 11/2000 Doyle ..... 327/539
6,265,857 B1 * 7/2001 Demsky et al. ..... 323/312

* cited by examiner

*Primary Examiner*—Matthew Nguyen
(74) *Attorney, Agent, or Firm*—Jack D. Slobod

(57) ABSTRACT

A voltage reference source arrangement (10; 20) is disclosed. The arrangement includes a voltage reference source (2) for: providing a first reference voltage ($V_B$) with a first temperature coefficient ($\alpha$). The arrangement further includes a plurality (N) of second voltage reference sources ($\mathbf{3}_i$) for providing compensation reference voltages ($V_{c,i}$) with second temperature coefficients ($\beta_i$), the sign of these second temperature coefficients ($\beta_i$) being opposite to the sign of the first temperature coefficient ($\alpha$). The arrangement further includes a plurality (N) of adders ($\mathbf{5}_i$) for adding the first reference voltage ($V_B$) and the compensation reference voltages ($V_{c,i}$). Thus, the voltage reference source arrangement can be designed with high accuracy.

12 Claims, 5 Drawing Sheets

BANDGAP VOLTAGE REFERENCE SOURCE

BACKGROUND OF THE INVENTION

1. Field of the Invention.

The present invention relates in general to a voltage reference source arrangement based on a bandgap voltage reference source.

2. Description of the Related Art

Bandgap voltage reference sources are commonly known. Conventionally, a bandgap voltage reference source arrangement includes a basic reference source having a negative temperature coefficient-and a compensation reference source having a positive temperature coefficient. The voltage provided by the compensation reference source is amplified such that the positive temperature coefficient substantially compensates the negative temperature coefficient of the basic reference source, and a reference voltage is obtained with a zero temperature coefficient.

A problem with such conventional reference source arrangement is that the compensation reference source may suffer from an offset voltage due to mismatches. Any such offset voltage will be amplified in the conventional reference source arrangement, with the consequence that the accuracy is poor.

In the art, there is a need for precision voltage sources. For instance, in battery operated devices, it is important that a user is signalled when the battery voltage drops below a threshold value, indicating that the battery should be replaced or recharged. Further, almost all kinds of analog-to-digital conversion and/or digital-to-analog conversion require a precision voltage reference sources for operating correctly.

Further, in the art, there is a further need for a voltage reference source with very specific characteristics. Specifically, in a practical example, there is a need for a voltage reference source having an output voltage of exactly 1V at a temperature of 27° C. while delivering a current of 5 mA, whereas the temperature coefficient should be exactly −1 mV/° C. in a large temperature range.

BRIEF SUMMARY OF THE INVENTION

It is a general objective of the present invention to provide a bandgap reference source arrangement with improved accuracy. Further, it is an objective of the present invention to provide a bandgap reference source arrangement where improved accuracy is an inherent property of the circuit design, without the need of complicated operations such as laser trimming, as is necessary in the current state of the art.

A further objective of the present invention is to provide a bandgap reference source arrangement with a predetermined non-zero temperature coefficient.

The invention is based on the insight that the mismatch and consequent offset in a compensation reference source is substantially random, and that the offsets of different compensation reference sources are uncorrelated. Based on this insight, the present invention provides a voltage reference source arrangement having a plurality of compensation reference sources. The number of such plurality corresponds to the amplification factor applied to the conventional compensation reference source. However, instead of amplifying the output of one single compensation reference source, the outputs of said plurality of compensation reference sources are added together. Each of said compensation reference sources may suffer from an offset, but in view of the fact that those offsets are uncorrelated, they may statistically eliminate each other. Formulated more correctly, the offset in the sum is less than the sum of the same offsets.

These and other aspects, characteristics and advantages of the present invention will be further clarified by the following description of a preferred embodiment of a voltage reference source arrangement in accordance with the invention.

DETAILED DESCRIPTION OF THE INVENTION

Figure 1:
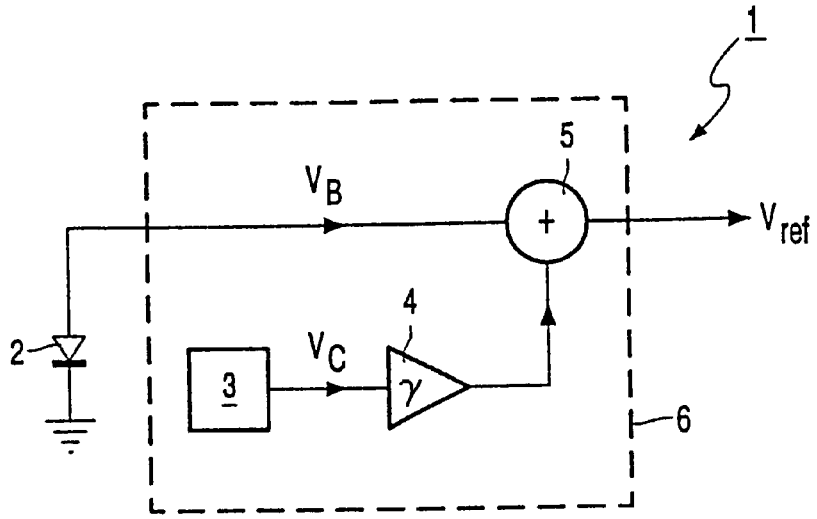
FIG. 1 (PRIOR ART)
FIG. 1 is a circuit diagram illustrating the principles of a conventional voltage reference source arrangement.

FIG. 1 illustrates the principles of functioning of a conventional voltage reference source arrangement 1. A PN-junction 2, for instance a diode, provides a basic reference voltage $V_B$. The PN-junction 2 has a temperature characteristic with an approximately constant, negative temperature coefficient $\alpha$. This means that, in a first order approximation, the temperature dependent basic reference voltage $V_B$ can be written as formula (1):

$$V_B(T)=V_B(T_{ref})+\alpha(T-T_{ref}) \quad (1)$$

Herein, $V_B(T)$ is the value of the basic reference voltage $V_B$ at a certain temperature T; and $V_B(T_{ref})$ is the value of the basic reference voltage $V_B$ at a reference temperature $T_{ref}$.

The negative temperature coefficient $\alpha$ is compensated in a compensation stage 6, which comprises a compensation reference source 3 based on the voltage difference between two PN-junctions (not shown) and providing a compensation reference voltage $V_C$. This compensation reference source 3 has a temperature characteristic with a positive temperature coefficient $\beta$. This means that, theoretically, the temperature dependent compensation reference voltage $V_C$ can be ideally written as formula (2):

$$V_C(T)=V_C(T_{ref})+\beta(T-T_{ref}) \quad (2)$$

herein, $V_C(T)$ is the value of the compensation reference voltage $V_C$ at a certain temperature T; and $V_C(T_{ref})$ is the value of the compensation reference voltage $V_C$ at a reference temperature $T_{ref}$.

The output voltage of compensation reference source 3 is amplified by an amplifier 4 with a voltage gain $\gamma$, which is chosen such that formula (3) is met:

$$\gamma=|\alpha/\beta| \tag{3}$$

From the above, it follows that, when designing the amplifier 4 of the circuit 1, the values of $\alpha$ and $\beta$ must be known beforehand.

In an adder 5, the output voltage of the amplifier 4 is added to the basic reference voltage $V_B$ of PN-junction 2 in order to provide the reference voltage $V_{ref}$ according to formula (4):

$$\begin{aligned} V_{ref}(T) &= \gamma V_C(T) + V_B(T) \\ &= \gamma[V_C(T_{ref}) + \beta(T - T_{ref})] + [V_B(T_{ref}) + \alpha(T - T_{ref})] \\ &= \gamma V_C(T_{ref}) + V_B(T_{ref}) \end{aligned} \tag{4}$$

Thus, the temperature coefficient of the reference voltage $V_{ref}$ will be zero when equation (3) applies, and consequently $V_{ref}$ will be equal to the bandgap voltage of the silicon.

The functioning of the compensation reference source 3 is based on the voltage difference between two PN-junctions, such as for instance two diodes, two bipolar transistors, or two MOS transistors operating in the weak inversion region with different area and/or with different current flowing into each. Due to mismatch in these two PN-junctions, and further due to imperfections in the amplifier 4, the compensation reference source 3 will, in practice, have an offset voltage $V_{off}$ in addition to its designed compensation reference voltage $V_C$. Consequently, formula (2) changes into formula (2'):

$$V_C(T)=V_C(T_{ref})+\beta(T-T_{ref})+V_{off} \tag{2'}$$

and formula (4) changes into formula (4'):

$$V_{ref}(T)=\gamma V_C(T_{ref})+\gamma V_B(T_{ref})+V_{off} \tag{4'}$$

Thus, the conventional design as illustrated in FIG. 1 has a drawback that any offset in compensation reference source 3, together with the input offset voltage of amplifier 4, is amplified by the gain $\gamma$ of the amplifier 4. In practice, $\gamma$ may be in the range of 8–14, and the reference voltage $V_{ref}$ as produced by the voltage reference source arrangement 1 will have a relatively large offset voltage, which can be as high as 100 mV.

Further, when comparing a large number of identically designed voltage reference source arrangements 1, they will produce reference voltages which will not be identical to each other but which will spread around a mean value $V_0$ equal to $\gamma\ V_C(T_{ref})+V_B(T_{ref})$, due to the fact that the offset voltages $V_{off}$ in the different compensation reference sources 3 will be random and uncorrelated.

Figure 2:
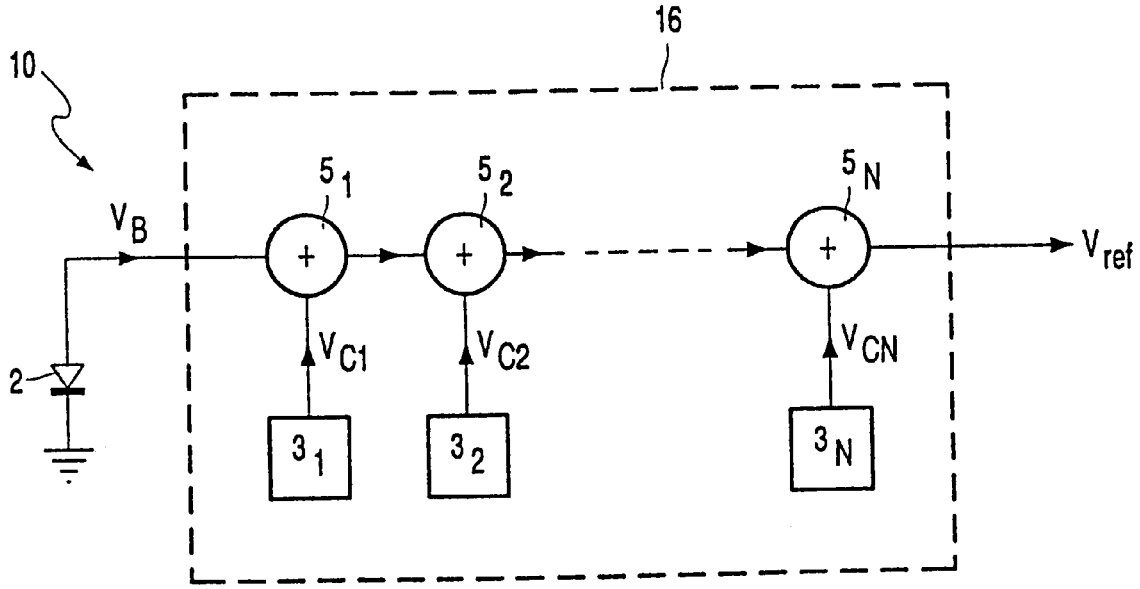
FIG. 2 is a circuit diagram illustrating the principles of a voltage reference source arrangement according to the present invention.

FIG. 2 illustrates the principles of functioning of a voltage reference source arrangement 10 according to the present invention. Similar to the conventional arrangement, a basic reference voltage $V_B$ is provided by a PN-junction 2, for instance a diode, having a temperature characteristic with a negative temperature coefficient $\alpha$ such that the temperature dependent basic reference voltage $V_B$ obeys formula (1):

$$V_B(T)=V_B(T_{ref})+\alpha(T-T_{ref}) \tag{1}$$

Compensation for the negative temperature coefficient $\alpha$ is, again, provided by a compensation stage 16 on the basis of adding a voltage with a positive temperature coefficient. However, the compensation stage 16 according to the present invention comprises a plurality of N compensation reference sources $\mathbf{3}_1$, $\mathbf{3}_2$, . . . $\mathbf{3}_N$, each of which may be identical to the conventional compensation reference source 3 described above. Each individual compensation reference source $\mathbf{3}_i$ (i=1–N) provides a compensation reference voltage $V_{C,i}$ which is added to the basic reference voltage $V_B$. In the example as illustrated, the compensation stage 16 according to the present invention comprises a plurality of N adders $\mathbf{5}_i$, each having two inputs and an output, each having one input connected to a corresponding individual compensation reference source $\mathbf{3}_i$ to receive the corresponding compensation reference voltage $V_{C,i}$. As an alternative, the compensation stage 16 might have one adder with N+1 inputs and one output, as will be clear to a person skilled in the art.

The temperature dependent compensation reference voltage $V_{C,i}$ of each individual compensation reference source $\mathbf{3}_i$ can be ideally written as formula (5):

$$V_{C,i}(T)=V_{C,i}(T_{ref})+\beta_i(T-T_{ref}) \tag{5}$$

herein,

- $V_{C,i}(T)$ is the value of the compensation reference voltage $V_{C,i}$ at a certain temperature T;
- $V_{C,i}(T_{ref})$ is the value of the compensation reference voltage $V_{C,i}$ at a reference temperature $T_{ref}$; and
- $\beta_i$ is the positive temperature coefficient of the compensation reference source $\mathbf{3}_i$.

The output reference voltage $V_{ref}$ of the voltage reference source arrangement 10 according to the present invention can be expressed as formula (6):

$$\begin{aligned} V_{ref}(T) &= V_B(T) + \sum\{V_{C,i}(T)\} \\ &= [V_B(T_{ref}) + \alpha(T - T_{ref})] + \sum\{V_{C,i}(T_{ref}) + \beta_i(T - T_{ref})\} \\ &= V_B(T_{ref}) + \sum\{V_{C,i}(T_{ref})\} + \{\alpha + \sum\beta_i\}(T - T_{ref}) \end{aligned} \tag{6}$$

wherein $\Sigma$ denotes summation from i=1 to N.

Thus, the temperature coefficient of the reference voltage $V_{ref}$ will be approximately zero when the absolute value of $\Sigma\beta_i$ is approximately equal to the absolute value of $\alpha$.

If, for all compensation reference sources $\mathbf{3}_i$, the temperature coefficients are equal to each other, then $\Sigma\beta_i$ can be written as $N\beta$, wherein N is the number of compensation reference sources.

As in the conventional design, the functioning of the compensation reference sources $\mathbf{3}_i$ is based on the voltage difference between two PN-junctions, and, due to mismatch in these two PN-junctions, the compensation reference sources $\mathbf{3}_i$ may, in practice, each have an offset voltage $V_{off,i}$ in addition to their designed compensation reference voltage $V_{C,i}$. Consequently, formula (5) changes into formula (5'):

$$V_{C,i}(T)=V_{C,i}(T_{ref})+\beta_i(T-T_{ref})+V_{off,I} \tag{5'}$$

and formula (6) changes into formula (6'):

$$V_{ref}(T)=V_B(T_{ref})+\Sigma\{V_{C,i}(T_{ref})\}+\{\alpha+\Sigma\beta_i\}(T-T_{ref})+\Sigma V_{off,I} \tag{6'}$$

Now, as mentioned above, the offset voltages $V_{off,i}$ of the compensation reference sources $\mathbf{3}_i$ are random and uncorrelated. Therefore, the sum $\Sigma V_{off,i}$ of the offset voltages $V_{off,i}$ will, in the mean, be less than N times the offset voltage $V_{off}$ of one compensation reference source 3. In other words, the accuracy of the voltage reference source arrangement 10 is improved with respect to the accuracy of the conventional voltage reference source arrangement 1. Further, when comparing a large number of identically designed voltage reference source arrangements 10, they will show some spread around a mean value, but the spread will be reduced in comparison to the conventional spread. More particularly, when replacing a conventional arrangement in which a gain factor $\gamma$ equal to N is employed by an inventive arrangement with N reference sources, the spread of the resulting reference voltages is reduced by $\sqrt{N}$. In practice, when N ranges from 8–14, the spread of the resulting reference voltages is reduced by 2.8–3.7.

If desired, a further improvement of the accuracy is possible by designing each compensation reference source $\mathbf{3}_i$ such that $\beta_i$ is smaller, resulting in a larger value of N. However, since this would result in a more complex design, involving use of a larger silicon area and higher costs, a trade-off has to be found between desired accuracy and acceptable costs when determining N.

Thus, in one aspect, an important advantage of the invention is to be recognised in the fact that random offsets are handled by averaging obtained by summation instead of multiplication obtained by amplification.

Further, the fact that an amplifier, including an op-amp and at least one resistor, is no longer needed constitutes an important advantage. The offset of the op-amp constitutes an important contribution to the total offset, and eliminating this op-amp also eliminates this offset contribution, resulting in an important decrease of the total offset.

Figure 3:
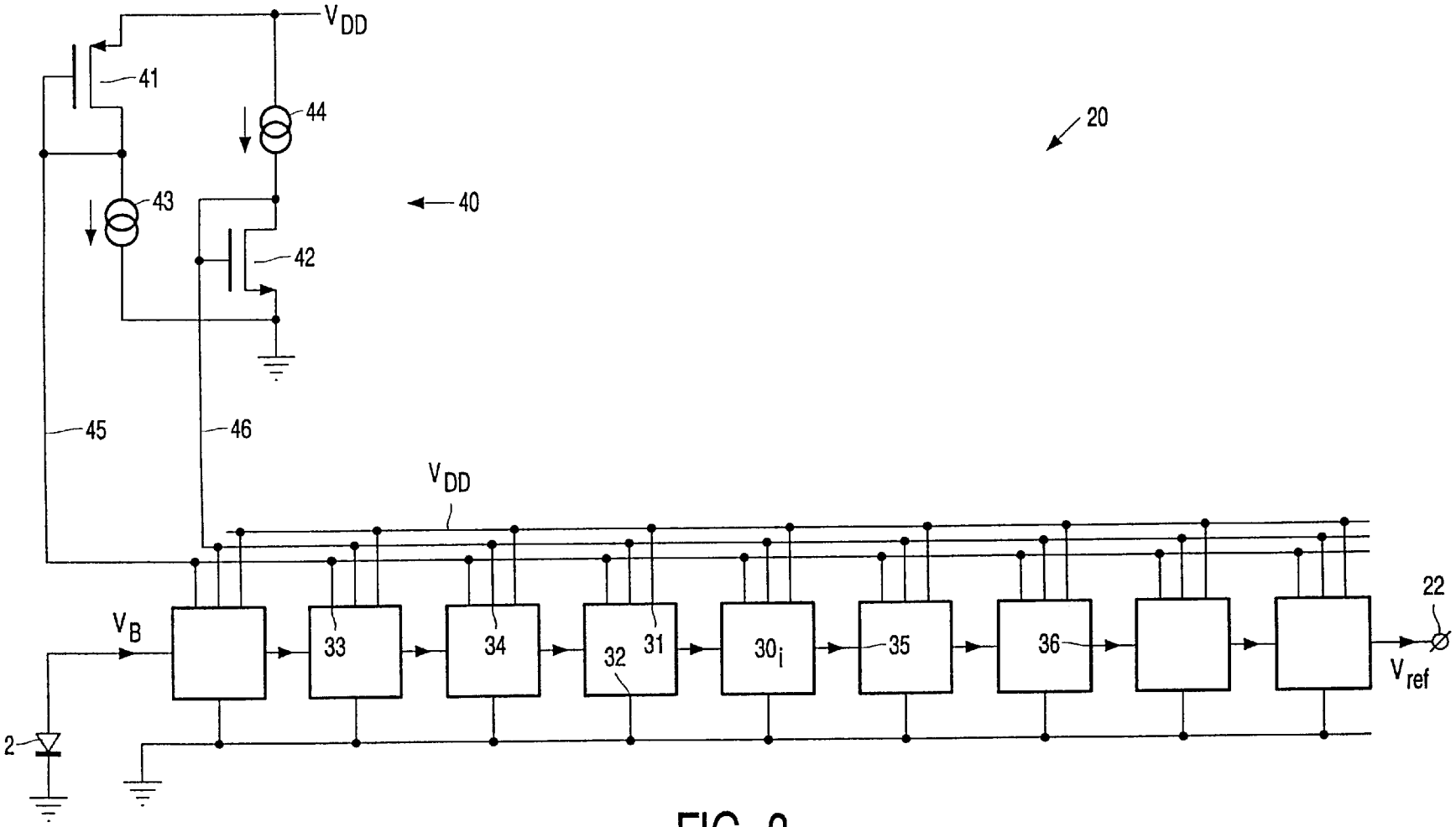
FIG. 3 is a circuit diagram illustrating a possible chip implementation of a voltage reference source arrangement according to the present invention.

FIG. 3 is a circuit diagram illustrating a possible chip implementation of a voltage reference source arrangement 20 according to the present invention. The circuit comprises a bias source 40, comprising a first P-transistor 41 and a second N-transistor 42. The first P-transistor 41 has its source coupled to a supply voltage $V_{DD}$, and has its drain coupled to ground GND through a first current source 43. The second N-transistor 42 has its source coupled to ground GND, and has its drain coupled to said supply voltage $V_{DD}$ through a second current source 44. The gate of the first P-transistor 41 is connected to the drain of this first P-transistor 41, and constitutes a positive bias output 45 of the bias source 40. The gate of the second P-transistor 42 is connected to the drain of this second P-transistor 42, and constitutes a negative bias output 46 of the bias source 40.

Figure 4:
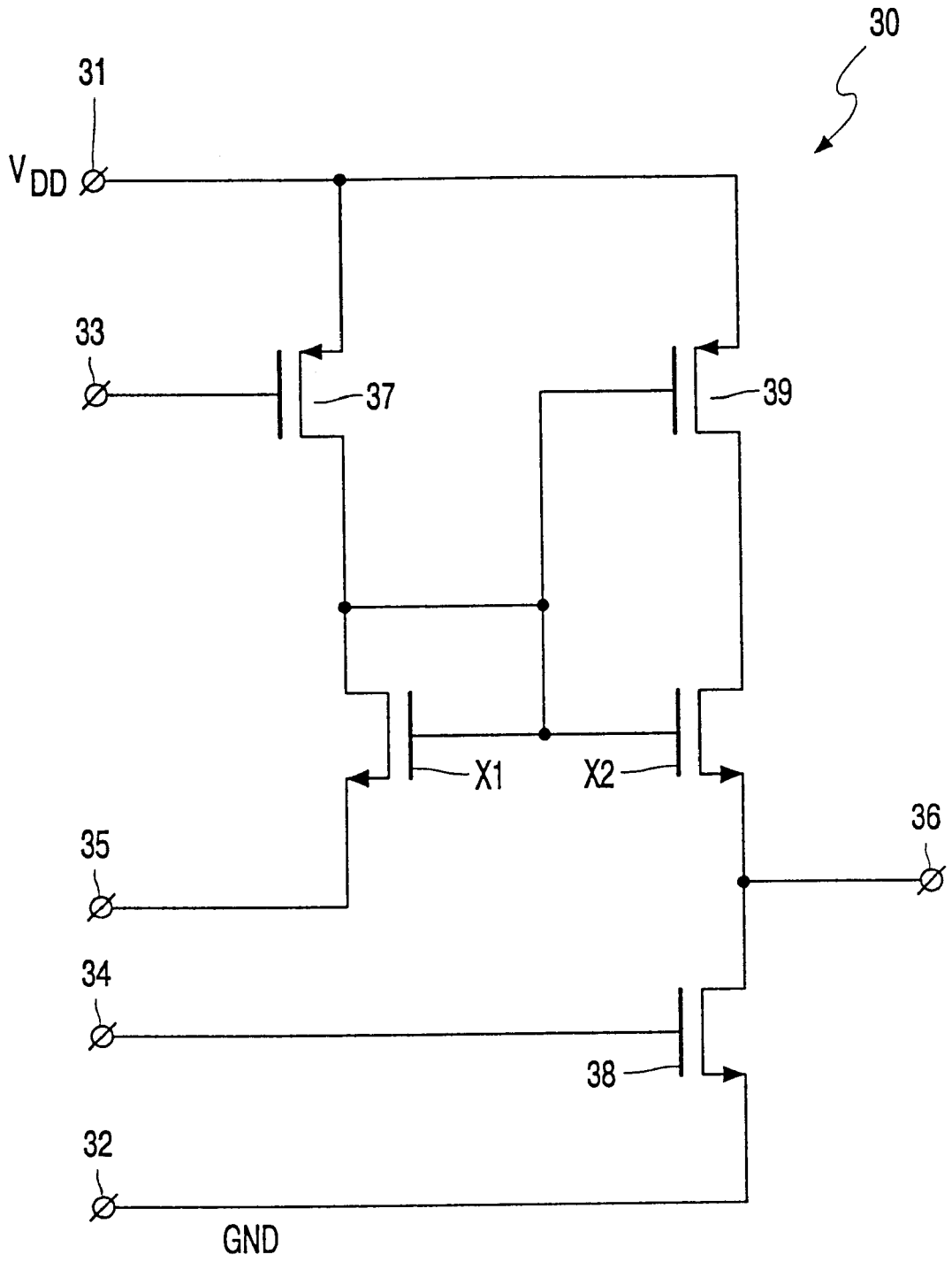
FIG. 4 is a circuit diagram illustrating a possible chip implementation of a compensation reference source for use in the voltage reference source arrangement of FIG. 3.

The circuit 20 comprises further a plurality (in this case: nine) of compensation cells $\mathbf{30}_i$, the implementation of which is illustrated more clearly in FIG. 4. Each compensation cell 30 has a supply voltage input 31, a second supply voltage input or ground input 32, a positive bias input 33, a negative bias input 34, a cell input 35 and a cell output 36. The supply voltage input 31 of each compensation cell 30 is connected to said supply voltage $V_{DD}$. The ground input 32 of each compensation cell 30 is connected to said ground GND. The positive bias input 33 of each compensation cell 30 is connected to said positive bias output 45 of the bias source 40. The negative bias input 34 of each compensation cell 30 is connected to said negative bias output 46 of the bias source 40. The cell input $\mathbf{35}_1$ of the first compensation cell $\mathbf{30}_1$ is connected to PN-junction 2 for receiving the basic reference voltage $V_B$. The cell input $\mathbf{35}_i$ of next compensation cells $\mathbf{30}_i$ is connected to the cell output $\mathbf{36}_{i-1}$ of the corresponding previous compensation cell $\mathbf{30}_{i-1}$. The cell output $\mathbf{36}_9$ of the last compensation cell $\mathbf{30}_9$ is connected to an output terminal 22 of the voltage reference source arrangement 20.

Each compensation cell $\mathbf{30}_i$ produces at its output $\mathbf{36}_i$ a cell output voltage $V_{OUT,i}$ equal to the cell input voltage $V_{IN,i}$ received at its input $\mathbf{35}_i$ plus a compensation voltage contribution $V_{C,i}$. Each compensation cell 30 comprises a first compensation N-transistor X1 and a second compensation N-transistor X2, having their gates connected together. Each compensation cell 30 comprises further a first bias P-transistor 37 and a second bias N-transistor 38, and a third bias P-transistor 39. The first bias P-transistor 37 has its source connected to the supply voltage input 31, has its gate connected to the positive bias input 33, and has its drain connected to the drain and the gate of the first compensation N-transistor X1. The second bias N-transistor 38 has its source connected to the ground input 32, has its gate connected to the negative bias input 34, and has its drain connected to the source of the second compensation N-transistor X2. The third bias P-transistor 39 has its source connected to the supply voltage input 31, has its gate connected to the gate node of the first and second compensation N-transistors X1 and X2, and. has. its drain connected to the drain of the second compensation N-transistor X2. The source of the first compensation N-transistor X1 is connected to the cell input 35; the source of the second compensation N-transistor X2 is connected to the cell output 36.

The two compensation transistors X1 and X2 are operating in the weak inversion. The first compensation N-transistor X1 receives a first bias current from the first bias P-transistor 37, and the second compensation N-transistor X2 receives a second bias current from the second bias N-transistor 38. In this design, the currents flowing through the two compensation transistors X1 and X2 are equal. However, the aspect ratio of the second compensation N-transistor X2 is Z times as large as the aspect ratio of the first compensation N-transistor X1. Therefore, a voltage difference $\Delta V$ is developed between the sources of the two compensation transistors X1 and X2, which implies that $V_{OUT}=V_{IN}+\Delta V$.

Herein, $\Delta V=U_T \ln(Z)$, wherein $U_T=25.9$ mV at room temperature (300 K). It is noted that the DC-current flowing into the second P-transistor 42 is twice as large as the DC-current flowing into the first P-transistor 41.

Further, it is noted that the same current as flowing into the first bias P-transistor 37 is also applied to the output of the compensation cell 30. If the current flowing into the second bias N-transistor $\mathbf{38}_9$ of the last compensation cell $\mathbf{30}_9$ is reduced by 2 by halving its size, this additional current is no longer needed, leading to lower power dissipation.

Figure 5A:
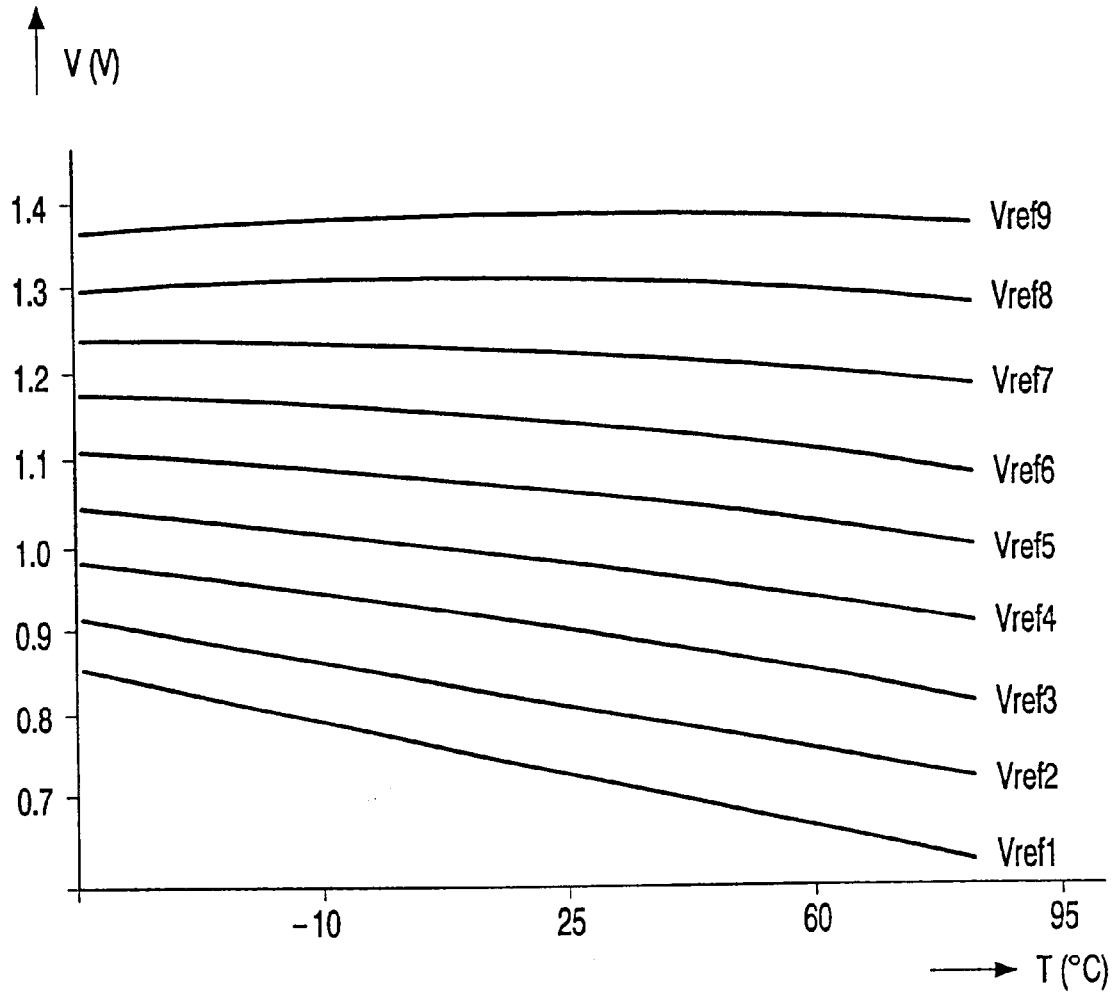
FIG. 5A is a graph showing the temperature characteristics of the voltage at subsequent stages in a simulated voltage reference source arrangement according to FIG. 3.
Figure 5B:
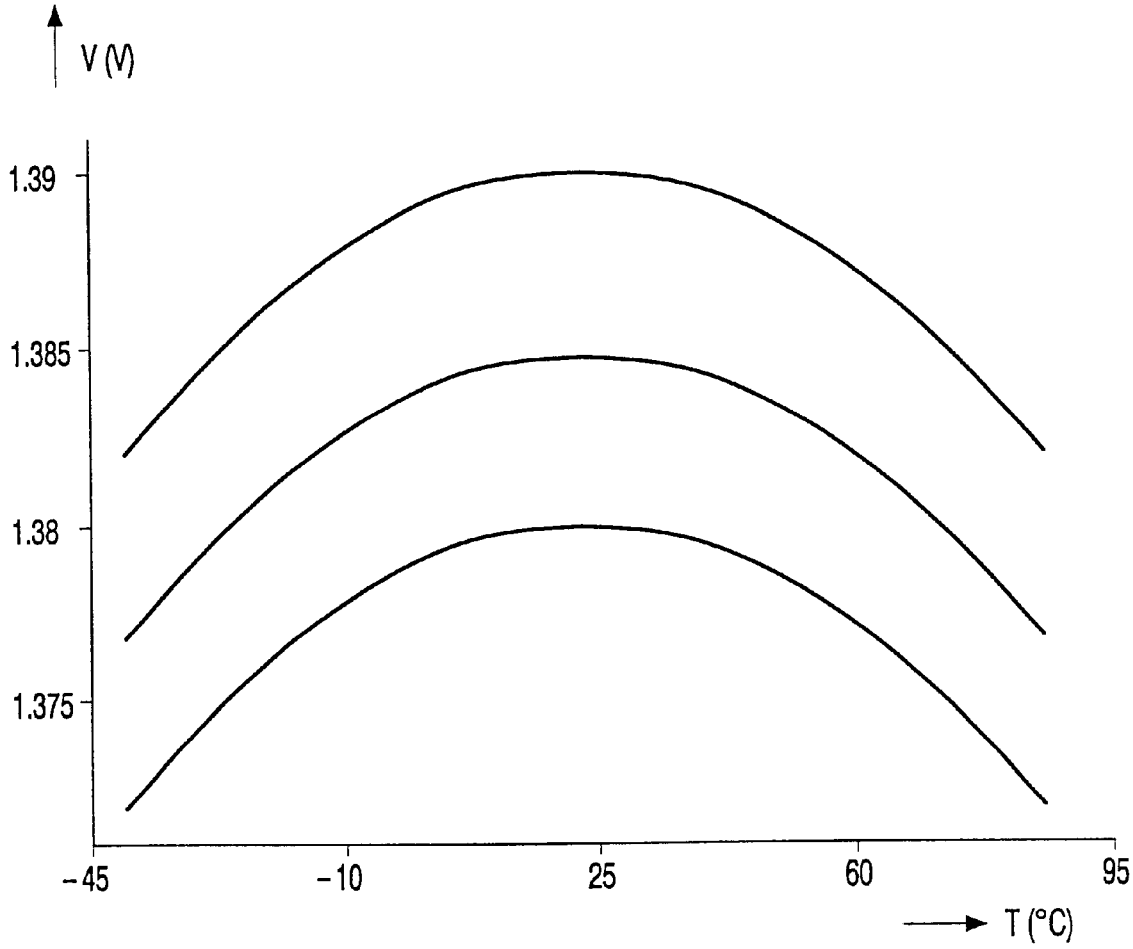
FIG. 5B is a graph showing the temperature characteristics of the output voltage of a simulated voltage reference source arrangement according to FIG. 3 for different values of the supply voltage.

The properties of the voltage reference source arrangement 20 shown in FIG. 3 have been examined in a simulation. The results are shown in FIG. 5A. The horizontal axis shows the device temperature in degrees Centigrade. The vertical axis shows voltage in Volt. The graph shows nine lines $V_{ref,1}$–$V_{ref,9}$, being the output voltages of the nine compensation cells $\mathbf{30}_i$, respectively. The graph clearly shows that the output reference voltage $V_{ref}$ of the voltage reference source arrangement 20, being equal to $V_{ref,9}$ of FIG. 5A, is very stable with respect to temperature variations: over the range from −40° C. to +85° C., the temperature coefficient was as low as 46 ppm/° C. FIG. 5B, wherein the output reference voltage $V_{ref,9}$ of FIG. 5A is shown for three different values of the supply voltage $V_{DD}$ (3.5 V for the top curve, 3 V for the middle curve, and 2.5 V for the lower curve), the scale of the vertical axis being enlarged, shows this even more clearly. Further, the simulation of this design showed a supply voltage coefficient of 0.7% and a total current drain as low as 0.9 $\mu$A.

By comparing the output voltages of the nine compensation cells $\mathbf{30}_1$–$\mathbf{30}_9$ as shown in FIG. 5A, it is clearly demonstrated that, when going from stage to stage, the output voltage increases due to addition of compensation voltage $V_C$, while further the temperature coefficient increases (from negative to approximately zero at room temperature) due to each compensation voltage $V_C$ having a positive temperature coefficient.

In the above, the invention has been explained in respect of the objective of providing a reference voltage source of which the output voltage is accurate and stable, meaning that its temperature coefficient is as low as possible, preferably zero; graph $V_{ref,9}$ of FIG. 5A, and also FIG. 5B, has demonstrated that this objective is attained, indeed. However, in some applications there is a need for a voltage reference source of which the output voltage has a temperature coefficient with a specified non-zero value. For instance, in a radio receiver there is a need for a reference voltage source having an output voltage of 1V at a temperature of 27° C. with a temperature coefficient of −1 mV/° C. in a large temperature range in order to compensate for the temperature coefficient of a low-noise amplifier. In accordance with the invention, such reference voltage source can easily be provided by choosing the number of compensation cells $\mathbf{30}_i$ in an appropriate way. For instance, with reference to FIG. 3 and FIG. 5A, more particularly graph $V_{ref,4}$, a voltage reference source arrangement 20 with four compensation cells would suffice to provide a temperature coefficient of approximately −1 mV/° C.

It should be clear to a person skilled in the art that the scope of the present invention is not limited to the examples discussed in the above, but that several amendments and modifications are possible without departing from the scope of the invention.

In the above, it is explained that the temperature coefficient of the reference voltage $V_{ref}$ will be zero when the absolute value of $\Sigma\beta i$ is equal to the absolute value of $\alpha$. In other words, $\Sigma\beta i$ should ideally be equal to the absolute value of $\alpha$; or, if all temperature coefficients are equal to each other, $N\beta$ should ideally be equal to the absolute value of $\alpha$, wherein N is the number of compensation reference sources. In practice, such will not always be possible. If the ratio $|\alpha/\beta|$ is not an integer, another compensation reference source can be added, including an attenuator, i.e. an amplifier with a gain g smaller than 1, between the compensation reference source and its corresponding adder, as will be explained in the following.

Assume that $|\alpha/\beta|$ can be written as M+R, wherein M is an integer and R has a value between 0 and 1. Consider a compensation stage 16 as illustrated in FIG. 2, comprising N identical compensation reference sources $\mathbf{3}_i$, in which N−1=M. Further, consider an amplifier connected between the output of the N-th compensation reference source $\mathbf{3}_N$ and its corresponding adder $\mathbf{5}_N$, the amplifier having a gain g=R. From equation (6), it will be clear that the temperature coefficient of the reference voltage $V_{ref}$ will be equal to zero:

$$\{\alpha+\Sigma\beta_i\}=\alpha+(N-1)\beta+g\beta=\alpha+(M+R)\beta=0$$

Similar calculation applies if the compensation reference sources $\mathbf{3}_i$ have mutually different values for $\beta$. Also, the attenuator need not necessarily be associated with the last compensation reference source $\mathbf{3}_N$ and its corresponding adder $\mathbf{5}_N$. Also, it is possible to have such attenuators associated with more than one compensation reference source.

What is claimed is:

1. A voltage reference source arrangement, comprising:

first voltage reference means (2) for providing a first reference voltage ($V_B$) with a first temperature coefficient ($\alpha$);

a plurality (N) of at least two second voltage reference means ($\mathbf{3}_i$; $\mathbf{30}_i$) for providing compensation reference voltages ($V_{C,i}$) with second temperature coefficients ($\beta_i$), a sign of the second temperature coefficients ($\beta_i$) being opposite to a sign of the first temperature coefficient ($\alpha$); and means ($\mathbf{5}_i$; $\mathbf{30}_i$) for adding the first reference voltage ($V_B$) and the compensation reference voltages ($V_{C,i}$).

2. The voltage reference source arrangement according to claim 1, wherein the plurality (N) of second voltage reference means ($\mathbf{3}_i$; $\mathbf{30}_i$) is in the range of 8–14.

3. A voltage reference source arrangement, comprising:

first voltage reference means (2) for providing a first reference voltage ($V_B$) with a first temperature coefficient ($\alpha$);

a plurality (N) of at least two second voltage reference means ($\mathbf{3}_i$; $\mathbf{30}_i$) for providing compensation reference voltages ($V_{C,i}$) with second temperature coefficients ($\beta_i$), a sign of the second temperature coefficients ($\beta_i$) being opposite to a sign of the first temperature coefficient ($\alpha$); and a plurality (N) of adders ($\mathbf{5}_i$), wherein each adder ($\mathbf{5}_i$) includes two inputs and one output, wherein a first adder ($\mathbf{5}_1$) has a corresponding first input coupled to receive the first reference voltage ($V_B$), wherein for i>1, each adder ($\mathbf{5}_i$) has a corresponding first input connected to the output of a previous adder ($\mathbf{5}_{i-1}$), and wherein each adder ($\mathbf{5}_i$) has a corresponding second input coupled to receive the compensation reference voltages ($V_{C,i}$) from an associated second voltage reference means ($\mathbf{3}_i$).

4. A voltage reference source arrangement, comprising:

first voltage reference means (2) for providing a first reference voltage ($V_B$) with a first temperature coefficient ($\alpha$);

a plurality (N) of at least two second voltage reference means ($\mathbf{3}_i$; $\mathbf{30}_i$) for providing compensation reference voltages ($V_{C,i}$) with second temperature coefficients ($\beta_i$), a sign of the second temperature coefficients ($\beta_i$) being opposite to a sign of the first temperature coefficient ($\alpha$); and a plurality (N) of compensation cells ($\mathbf{30}_i$), wherein each compensation cell ($\mathbf{30}_i$) includes a cell input ($\mathbf{35}_i$), a cell output ($\mathbf{36}_i$), and voltage difference means (X1, X2) coupled between the cell input ($\mathbf{35}_i$) and the cell output ($\mathbf{36}_i$), said voltage difference means (X1, X2) being arranged for maintaining a voltage difference ($V_{C,i}$) between the cell output ($\mathbf{36}_i$) and the cell input ($\mathbf{35}_i$), wherein a first compensation cell ($\mathbf{30}_i$) has a corresponding cell input ($\mathbf{35}_i$) coupled to receive the first reference voltage ($V_B$), and wherein for i>1, each compensation cell ($\mathbf{30}_i$) has a corresponding cell input ($\mathbf{35}_i$) connected to the cell output ($\mathbf{36}_i$) of a previous compensation cell ($\mathbf{30}_{i-1}$).

5. The voltage reference source arrangement according to claim 4, wherein, for each compensation cell ($\mathbf{30}_i$):

said voltage difference means (X1, X2) includes a first compensation transistor (X1) of a first conductivity type and a second compensation transistor (X2) of the same conductivity type;

a first gate of the first compensation transistor (X1) is connected to a second gate of the second compensation transistor (X2); and a first source of the first compensation transistor (X1) is connected to the cell input (35) of the compensation cell ($30_i$) and a second source of the second compensation transistor (X2) is connected to the cell output (36) of the compensation cell ($30_i$).

6. The voltage reference source arrangement according to claim 5, wherein:

each compensation cell ($30_i$) further includes a first bias P-transistor (37) and a bias N-transistor (38);

the first compensation transistor and the second compensation transistor (X1, X2) are N-type;

a first drain of the first compensation transistor (X1) is coupled to a first supply voltage ($V_{DD}$) by a first gate of the first bias P-transistor (37) being connected to a positive bias input (33) of the compensation cell ($30_i$); and the second source of the second compensation transistor (X2) is further coupled to a second supply voltage (GND) by a second gate of the bias N-transistor (38) being connected to a negative bias input (34) of the compensation cell (30i).

7. The voltage reference source arrangement according to claim 6, wherein each compensation cell (30i) further includes a second bias P-transistor (39) having a third source connected to the first supply voltage ($V_{DD}$), a second drain connected to the first drain of the second compensation N-transistor (X2), and a third gate connected to the first gate the first compensation transistor and the second gate of the second compensation transistor.

8. The voltage reference source arrangement according to claim 5, wherein the first compensation transistor and the second compensation transistor (X1, X2) are operating in the weak inversion region.

9. The voltage reference source arrangement according claim 5, wherein the aspect ratio of the second compensation transistor (X2) is larger than the aspect ratio of the first compensation transistor (X1).

10. The voltage reference source arrangement according to claim 1, wherein an attenuator is coupled between at least one of said second voltage reference means ($3_i$; $30_i$) and a corresponding adding means ($5_i$; $30_i$).

11. The voltage reference source arrangement according to claim 3, wherein an attenuator is coupled between at least one of said second voltage reference means ($3_i$; $30_i$) and a corresponding adder ($5_i$).

12. The voltage reference source arrangement according to claim 3, wherein an attenuator is coupled between at least one of said second voltage reference means ($3_i$; $30_i$) and a corresponding compensation cell ($30_i$).

* * * * *